United States Patent [19]

Thudt

[11] Patent Number: 4,745,900

[45] Date of Patent: May 24, 1988

[54] CONTROL DEVICE FOR THE ADJUSTMENT OF THE INJECTION TIMING AND/OR THE DELIVERY RATE OF A FUEL INJECTION PUMP

[75] Inventor: Hubert Thudt, Puchheim/Bahnhof, Fed. Rep. of Germany

[73] Assignee: MAN Nutzfahrzeuge GmbH, Munich, Fed. Rep. of Germany

[21] Appl. No.: 75,116

[22] Filed: Jul. 20, 1987

[30] Foreign Application Priority Data

Jul. 25, 1986 [DE] Fed. Rep. of Germany ..... 3625235
Apr. 18, 1987 [DE] Fed. Rep. of Germany ..... 3713288

[51] Int. Cl.[4] ..... F02M 39/00
[52] U.S. Cl. ..... 123/357; 123/372
[58] Field of Search ..... 123/357, 358, 359, 372, 123/500, 501

[56] References Cited

U.S. PATENT DOCUMENTS

| | | | |
|---|---|---|---|
| 3,485,228 | 12/1969 | Updyke | 123/358 |
| 4,212,279 | 7/1980 | Ohtani | 123/357 |
| 4,270,502 | 6/1981 | Seilly | 123/357 |
| 4,425,889 | 1/1984 | Hachitani | 123/357 |
| 4,495,914 | 1/1985 | Ishii | 123/198 OB |
| 4,523,562 | 6/1985 | Schnapper | 123/357 |
| 4,543,914 | 10/1985 | Harris | 123/357 |
| 4,576,130 | 3/1986 | Hafele | 123/357 |

*Primary Examiner*—Carl Stuart Miller
*Attorney, Agent, or Firm*—Scully, Scott, Murphy & Presser

[57] ABSTRACT

The invention relates to a control device for the adjustment of the injection timing and/or the pumping rate of a fuel injection pump for IC engines in which the control commands from a microprocessor are transmitted by way of an electrical stepper motor via motion transmitting members with an intermediate spring force storage means to a control rod of the pump, there is a return compression spring with which the control rod may be returned from any position thereof to the zero delivery position. The stepper motor, the motion transmitting members, the spring force storage means and the return spring, an electro-mechanical tachometer generator driven by the injection pump shaft and responding to the speed of rotation thereof and a step generator responding to the steps of the stepper motor, are arranged as a sub-assembly, which is either adapted to be mounted on the outside of the injection pump in an assembled condition or, with the essential components in an assembled condition, are able to be connected with other assembled parts on the control rod and/or on the injection pump shaft when the injection pump is fitted in place.

16 Claims, 10 Drawing Sheets

CONTROL DEVICE FOR THE ADJUSTMENT OF THE INJECTION TIMING AND/OR THE DELIVERY RATE OF A FUEL INJECTION PUMP

BACKGROUND OF THE INVENTION

The invention relates a control device for the adjustment of the injection timing and/or the delivery rate of a fuel injection pump for IC engines in which the control signals from a microprocessor are transmitted by way of an electrical stepper motor via motion transmitting members with an intermediate spring force storage means to a control rod of the pump.

A control device with these features has been proposed in the European Pat. No. 00 69 111 B1 whose spring storage means serves the following purpose: When the microprocessor brings about a setting step which coincides with a pumping event in the injection pump the control rod is then temporarily locked so that it cannot be set, but if however the storage means temporarily accepts one or more steps of the electrical servo motor as a sort of buffer it may then pass on such temporarily stored steps when the control rod is no longer locked so that all the setting steps may be effected, i.e. converted into a respective resetting the position of the control rod. Furthermore in the form of the invention shown in FIG. 2 there is a security device in the form of a return spring connected with a hydraulic controlling device with which the control rod may, when needed, be moved out of any desired set position quickly into the zero delivery position. The prior art control device is however excessively elaborate in every respect both as regards the amount of components and also as regards the amount of space and not only with respect to the last-mentioned security device but also with respect to the overall mechanical setting step transmitting system.

In control devices of the initially mentioned type reference and check signals are required for coping with the operating commands to which the stepper motor has to respond for a respective setting of the control rod. The reference signals which are supplied to the microprocessor as command signals are as a rule supplied by devices such as tachometer generators, which are located on the crank shaft or a cam shaft of the IC engine. As a rule there is no provision for feedback indicating whether the commands from the microprocessor have been correctly performed by the stepper motor, because when there is a spring force storage means included in the transmitting means connecting the stepper motor with the control rod it is fair to assume that the desired setting will be effected, possibly with a slight lag in time. However, this assumption will only apply for the case in which the control rod is generally free to move, i.e. not impeded. In cases in which for one reason or another the control rod is locked for a prolonged time (and not just for a short time) they are not able to be detected by the control device and are thus not taken into account. This is found to be a disadvantage as well in the control device of the said European Pat. No. 00 69 111 B1.

Furthermore the German unexamined specification No. 2,417,771 describes a control device of the initially specified type, in which a stepper motor, motion transmitting members connecting it with the control rod, a return spring and a tachometer generator are present arranged within a closed housing flange-mounted on the injection pump. The same parts are furthermore exactly customized to suit the type of injection pump with which they are utilized. The rotor of the stepper motor used in the system in such that its drive shaft may practically only perform a relatively small rotational movement of 90° at the most, because of the motion transmitting members used, in order to move the control rod along its full stroke. This means that only a relatively coarse setting is possible. The encapsulation of the components in the housing is a shortcoming inasfar as the parts therein may only be taken out of it, for example for a repair, after complex and extensive dismounting operations. They may then be replaced by intact parts. Since the parts of the assembly are customized to suit one specific injection pump it is practically impossible to use them in any other injection pumps and types thereof.

SUMMARY OF THE INVENTION

Taking this prior art into account it is thus one object of the invention to develop a control device of the initially mentioned type so that it has means for supplying reference and check or feedback signals.

A further object of the invention is to devise such a system which has a very small space requirement in its position mounted on an injection pump.

A still further aim of the invention is to provide such a control device which may be adapted to suit a wide range of different injection pumps.

Another aim of the invention is to provide a control system which may be readily repaired in the event of a defect occurring.

In order to achieve these or other objects appearing herein, in a control device for the adjustment of the injection timing and/or the pumping rate of a fuel injection pump for IC engines in which the control commands from a microprocessor are transmitted by way of an electrical stepper motor via motion transmitting members with an intermediate spring force storage means to a control rod of the pump, there is a return compression spring with which the control rod may be returned from any position thereof to the zero delivery position. The stepper motor, the motion transmitting members, the spring force storage means and the return spring and furthermore an electro-mechanical tachometer generator driven by the injection pump shaft and responding to the speed of rotation thereof and a step generator responding to the steps of the stepper motor are arranged as a subassembly which is either adapted to be mounted on the outside of the injection pump in an assembled condition or, with the main components in an assembled condition, are able to be connected with other assembled parts on the control rod and/or on the injection pump shaft when the injection pump is fitted in place.

Owing to the arrangement in accordance with the invention of the individual parts of the control device, the result is an extremely compact overall assembly which is able to be either attached in a completely or generally completely assembled state (i.e. as a subassembly) on the outside of the injection pump. Dependent on the particular design of the system, it is thus possible for various parts to be mounted on the injection pump, as for example its shaft or control rod, such parts of the injection pump being suitably adapted to such fitting. Furthermore owing to the configuration of the control device of the invention it is possible for its components to be adapted to fit various different types of injection pump in an extremely simple manner. In the event of a different step generator being required, the generator previously fitted is removed from the housing and replaced by fitting a different one in its place. The same applies in the event of a different tachometer generator or an other step-down linkage being needed, the respective component as such being detached or removed and a suitable replacement put in its place. The control device in accordance with the present invention is also such as to make possible the adaptation of injection pumps operated by a centrifugal force governor to an electro-mechanical control system at any time, in which respect owing the above-mentioned possibilities there is a universal adaptation to the characteristics of the respective injection pump. The control device embodying the instant invention offers great advantages as well from the point of view of logistics, more especially as regards the warehousing and service network aspect, because a series of different components are collected together in the form of a single control block.

The following detailed account is devoted to a control device of the invention which refers to the accompanying drawings.

LIST OF THE SEVERAL FIGURES OF THE DRAWINGS

DETAILED DESCRIPTION OF WORKING EMBODIMENTS OF THE INVENTION

Figure 1:
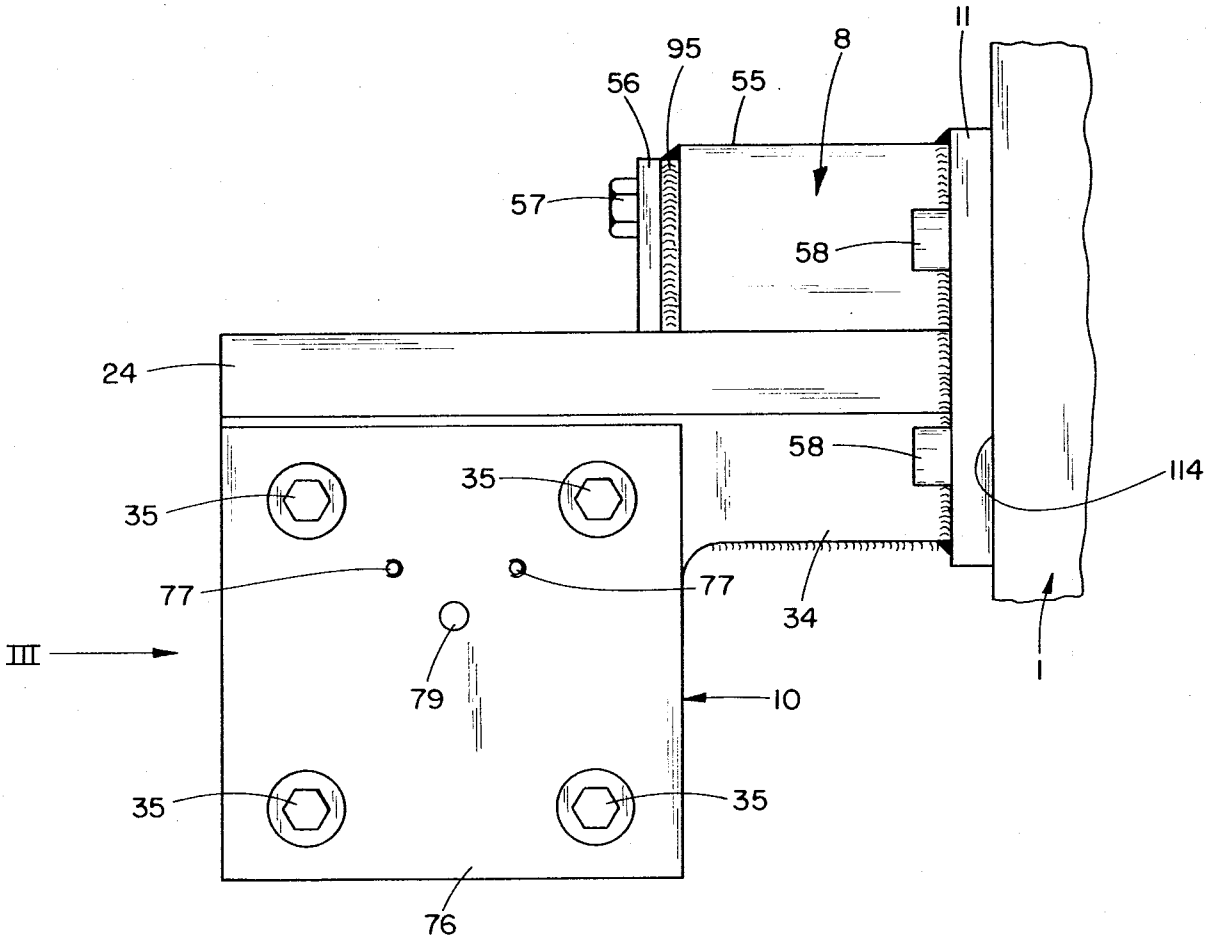
FIG. 1 is a side view of the control device in accordance with the invention as mounted on an fuel injection pump.
Figure 2:
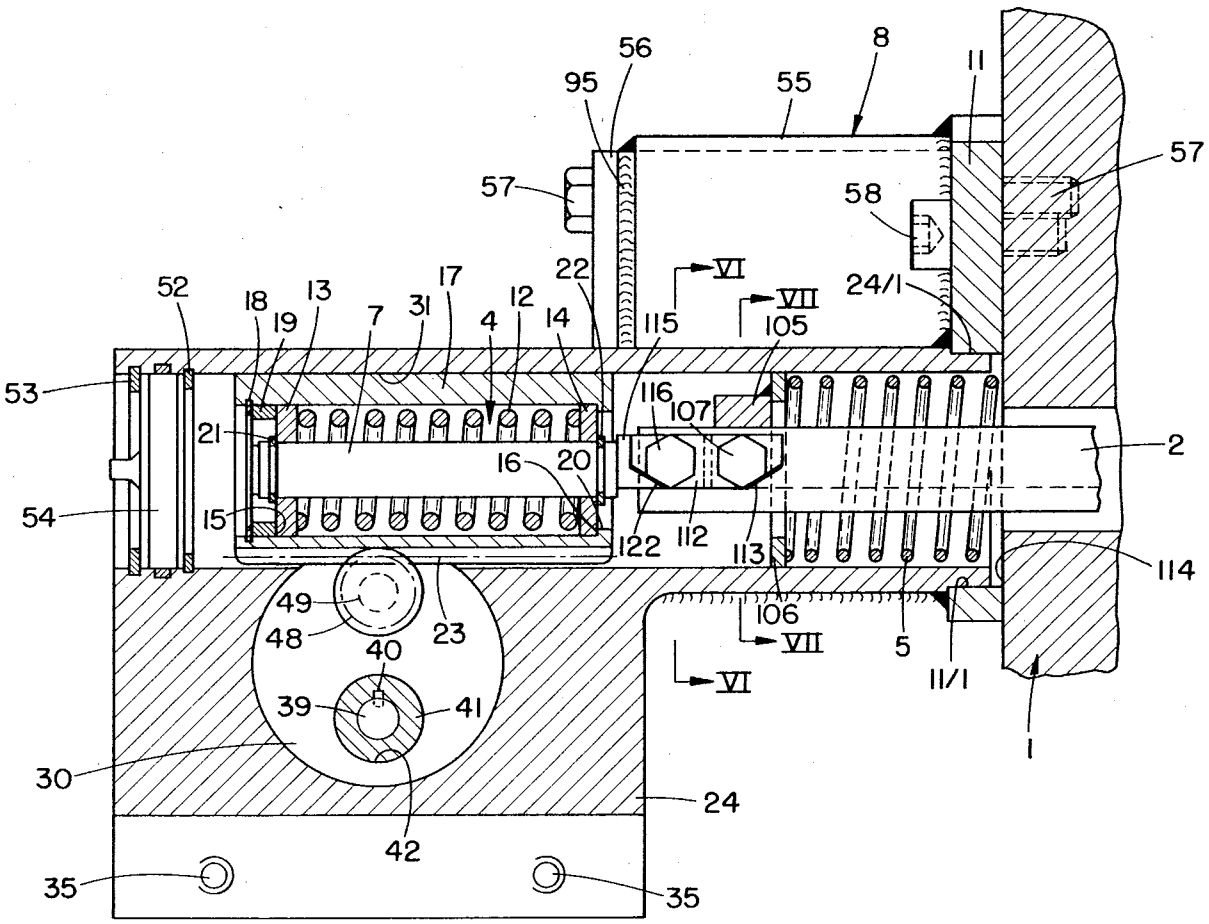
FIG. 2 shows a section taken through this control device on the section line II—II which has been entered on FIG. 4.
Figure 3:
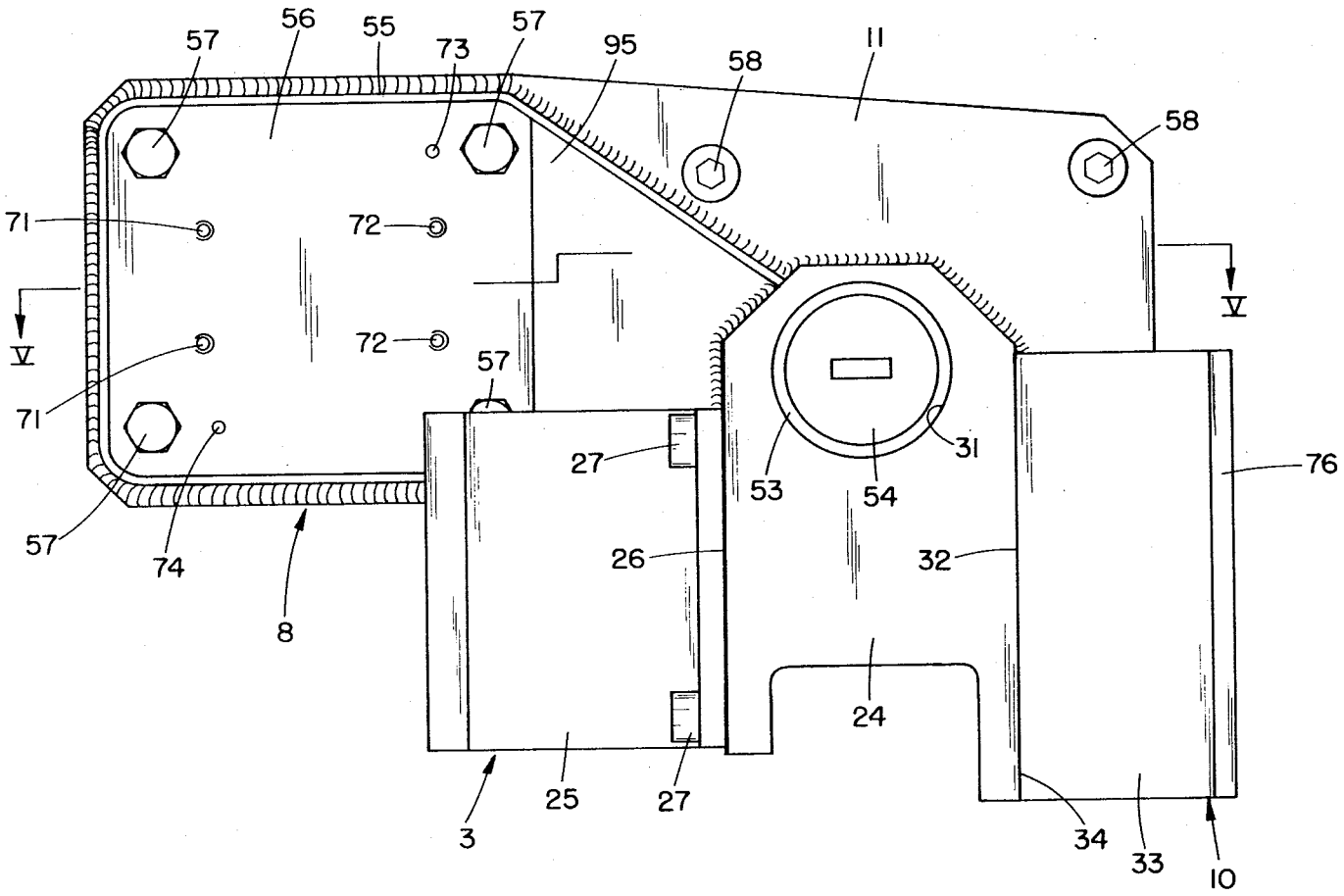
FIG. 3 is a front view of the control device as shown in FIG. 1 but looking in the direction of the arrow III.

In the figures like parts and functionally identical parts of the different working examples of the invention are denoted by the same reference numerals.

The control device described in detail in what follows serves to set the timing and/or the pumping rate of a fuel injection pump for IC engines. The fuel injection pump is only shown with its housing where the control device in accordance with the invention is to be mounted, and is denoted by reference numeral 1. Within the fuel injection pump 1 the setting of the pumping members, not shown, takes place directly or indirectly by way of a control rod 2, by means of which control signals from a microprocessor (which is as a rule mounted adjacent to the electronic engine controls), interpreted by an electric stepper motor 3 and transmitted by several motion transmitting members including an intermediate spring force storage means 4, are caused to take effect. The spring force storage means 4 is such that it may store one or more steps of the electric stepper motor 3 temporarily, this being more especially the case if the microprocessor outputs a setting step which in time coincides with a pumping stroke of the fuel injection pump so that there is a substantial force opposing the setting of the control rod 2. After this relatively short locking or jamming of the control rod, the setting steps stored by the spring force storage means 4 as a force are then able to take effect on the control rod 2 so that the same may now assume its correct terminal position, albeit with some time lag in relation to the setting pulse.

The control rod 2 is furthermore provided with a return spring 5, whose stiffness is such that, taking into account the parts of the control device connected with the control rod 2, it may move the control rod 2 out of any position into which it has been set.

In the working examples of the invention shown in the form of a control device, the motion transmitting member on the stepper motor is designed as a suitably adapted form of step-down gearing 6, which is placed between the stepper motor 3 and the spring force storage means 4 to provide a driving connection therebetween. The motion transmitting member joined to the control rod 2 is a force transmitting rod 7 which produces a connection between the spring force storage means 4 and the control rod 2.

Generally the control device of the invention further comprises a mechanical tachometer generator 8, which responds to the speed of rotation of the injection pump shaft 9 and supplies respective signals to the microprocessor. A further part of the control device of the invention is an electro-mechanical step generator 10 which may be driven by the stepper motor 3, detects the steps performed thereby and feeds back corresponding signals to the microprocessor.

The supporting member for the above-mentioned parts, or at least for the majority thereof is a base plate 11, which is adapted to be externally secured to the fuel injection pump 1.

The following account is devoted to details of the control device of the present invention.

The spring force storage means 4 consists of two oppositely moving spring plates 13 and 14 with a tensioned compression spring 12 therebetween and whose maximum distance apart is limited by abutments 15 and 16 in a housing 17 fitting around them. The housing 17 is in the form of a cylindrical tube and at one end the abutment 15 is formed by an abutment ring 19 locked in place by a locking ring 18. The other abutment 16 is formed by an abutment pin 20 formed at the other end of the housing 17. The spring force storage means 4 formed in this manner has the force transmitting rod 7 extending through it along its length at least past its two spring plates 13 and 14, when it is in the assembled condition and is then between two abutments 21 and 22 arranged on the rod 7. In the working example of the invention to be seen in FIGS. 1 through 7 and 9 these abutments 21 22, between which the two spring plates 13 and 14 of the spring force storage means 4 are placed, are in the form of locking rings placed in annular grooves in the force transmitting rod 7. On the other hand in the case of the working example of FIGS. 10 through 12 the abutment 22 to be seen on the right is formed by a collar on the force transmitting rod 7 and having a larger diameter, and it is only the abutment 21 to be seen on the left in the drawing which is formed by a locking ring inserted into an annular groove 21/1 in the force transmitting rod 7.

Figure 4:
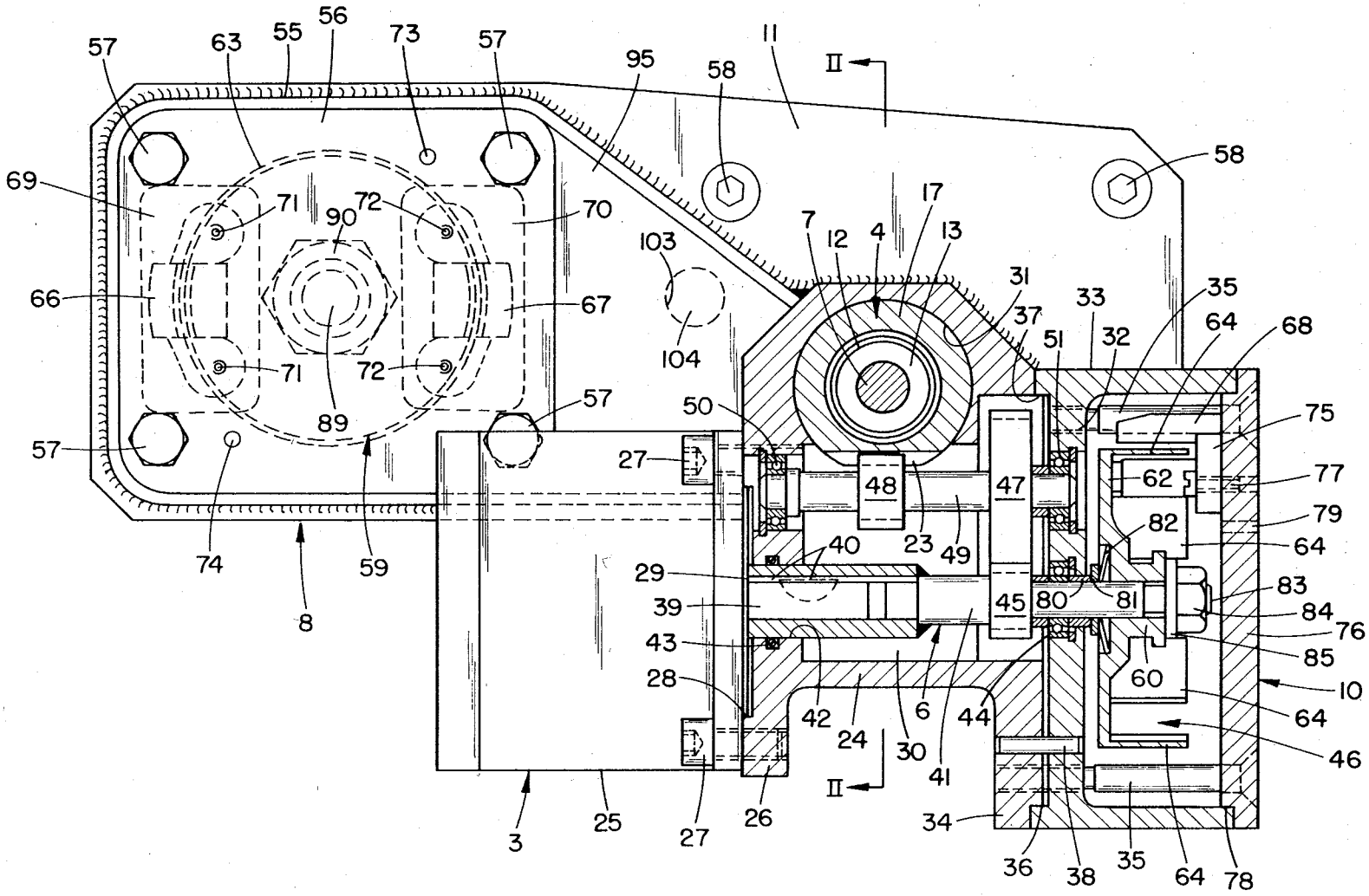
FIG. 4 is a section taken through this control device as such as taken on the line IV—IV entered in FIG. 5.

For forming a rack there is a suitably designed linear tooth configuration 23 on the outside of the housing 17 of the spring force storage means 4 with an alignment parallel to the axis. This linear tooth configuration 23 is drivingly connected with the gear step-down transmission 6, the latter being coupled with the stepper motor 3 on the force input side. This step-down gear transmission 6, which is of identical construction in all embodiments of the invention and will be seen in full detail in FIG. 4, is accommodated, like the spring force storage means 4 in a common housing 24. This housing 24 is securely fixed to the base plate 11 and positioned by means of a locating pin 24/1 extending into a through hole 11/1. The stepper motor 3 is arranged on one side of this housing 24 and the step generator 10 on the other. As will be seen from FIGS. 3 and 4 the stepper motor 3 with its housing 26 is flange-mounted externally on a side wall 25 of the housing 24, on which it is indirectly located in the correct position and detachably secured by screws 27. As will be seen from FIG. 4 the location in the desired position is ensured by a cylindrical recess 28 in the side wall 26 of the housing 24 in order to receive a locating pin 29 projecting past the mounting surface on the housing 25 of the stepper motor. In the housing 24 there is an accommodating space 30 for the step down gear transmission 6 and there is a receiving hole 31 for the spring force storage means 4. The accommodating space 30 is open towards the step generator 10 when the latter is mounted on the housing 24 but it is also covered by the floor 32 of this housing 33. In the mounted state the step generator 10 is externally flange-mounted on the other side wall 34, opposite and parallel to the side wall 26, of the housing 24, on which it is indirectly located and detachably held in place by means of screws 35. For locating the housing 33 of the step generator in relation to the housing 24 on its side wall 34 the latter has a projecting locating pin 36, which fits into a suitably adapted locating recess 37 in the floor 32 of the housing 33 of the step generator. In order to prevent twisting out of position there is furthermore a transverse pin 38, which passes through mutually aligned holes in the side wall 34 of the housing and in the floor 32 of the housing 33 of the step generator.

In the embodiment of the invention illustrated the shaft, denoted 39, of the stepper motor 3 is coupled by means of a groove and key connection 40 with the input shaft 41 of the step down gear transmission 6. In this respect the input shaft 41 has its cylindrical tubular end overlapping the motor shaft 39 and is here bearinged in a hole 42 in the side wall 26 of the housing 24. A sealing ring 43 prevents the access of leaking oil to the stepper motor 3. The input shaft 41 extends right the way through the transmission accommodating space 30 for the step-down transmission 6 in a direction parallel to the axis, extends as far as a point within the step generator housing 25 and is supported in the floor 32 thereof by means of a ball bearing 44 therein. On this side of the ball bearing 44, that is to say within the accommodating space 30, the input shaft 41 has a first gearwheel 45 of the step-down transmission 6 and on the other side of the ball bearing 44, that is to say within the housing 33 of the step generator it has a pulse generator rotor 46 as part of the step generator 10.

In addition to the gearwheel 45 the step-down transmission 6 comprises a further, second gearwheel 47 and a third gearwheel 48. The two gearwheels 47 and 48 are spaced from each other and arranged on the output shaft 49 of the step-down transmission 6. The shaft 49 has its one end mounted in the side wall 26 of the housing 24 by means of a ball bearing 50 in this wall, while its other end is supported in the floor 32 of the housing 33 of the step generator in a ball bearing 51 therein. The output shaft 49 is arranged so that its axis is parallel to the input shaft 41. The second gearwheel 47 meshes with the first gearwheel 45 and has a larger diameter than it. The third gearwheel 48 of the step-down gear transmission 6 is in mesh with the linear tooth configuration 23 extending along the outside of the housing 17 of the spring force storage means 4. The transmission ratio of the step-down gear transmission 6 is determined by the diameter and the number of teeth of the three gearwheels 35, 47 and 48. In the working examples shown the first gearwheel 45 has ten teeth, the second gearwheel 47 has twenty-five teeth and the third gearwheel 48 has nine teeth.

The spring force storage means 4 is so arranged in the receiving hole 31 in a plane normal to the shafts 41 and 49 of the step-down gear transmission 6 that on rotation of the third gearwheel 48 it is moved axially, that is to say between two settings. One of these settings corresponds to the maximum delivery setting of the control rod 2 and is defined or limited by an abutment on the fuel injection pump 1, such abutment not being shown. The second terminal setting, which corresponds to the zero delivery setting, is limited in the receiving hole 31 by an abutment arranged therein, which is formed by a locking ring 52 mounted in an annular groove. Adjoining this locking ring 52 the receiving hole 31 for the spring force storage means 4 is sealed off by a plug 54 to prevent the escape of leaked oil. The plug is locked in place by a further locking ring 53 mounted in an annular groove and is surrounded externally by a sealing ring. Oil leaking from the injection pump 1 might otherwise have access to it.

The hole 31 having the spring force storage means 4 therein extends right the way through the housing 24 and intersects the receiving space 30 for the transmission 6 in order to make space for the third gearwheel 48 of this transmission.

In addition to the housing 24 the tachometer generator 8 is also mounted on the base plate 11. In this respect the base plate 11 carries at least the housing 55 of the tachometer generator, such housing 55 being fixedly secured to the base plate 11, as for example by welding, molding or screwing. Reference numeral 56 denotes the housing cover of the tachometer generator 8 which is held by screws 57 on the housing 55. These screws 57 simultaneously serve to secure the base plate 11 on the injection pump 1 and in this respect they extend through the housing 55 of the tachometer generator 8 and through holes in the base plate 11 in an axial direction completely and in the mounted state on the injection pump 1 fit into tapped holes therein. Further securing means for the base plate 11 on the injection pump 1 include screws 58.

Figure 5:
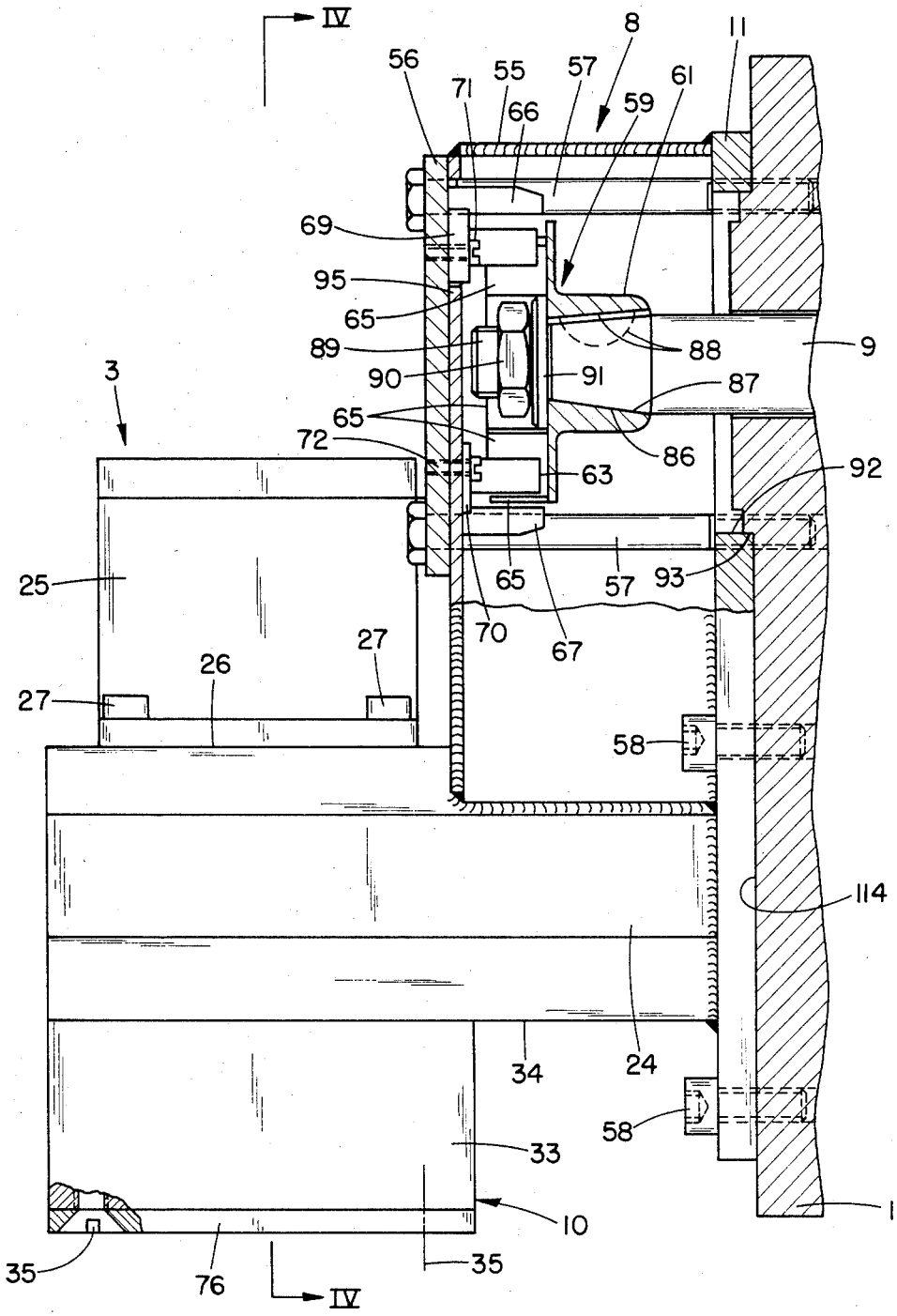
FIG. 5 is a section of the control device as seen in the mounted condition on the fuel injection pump, taken on the line V—V entered in FIG. 3.
Figure 8:
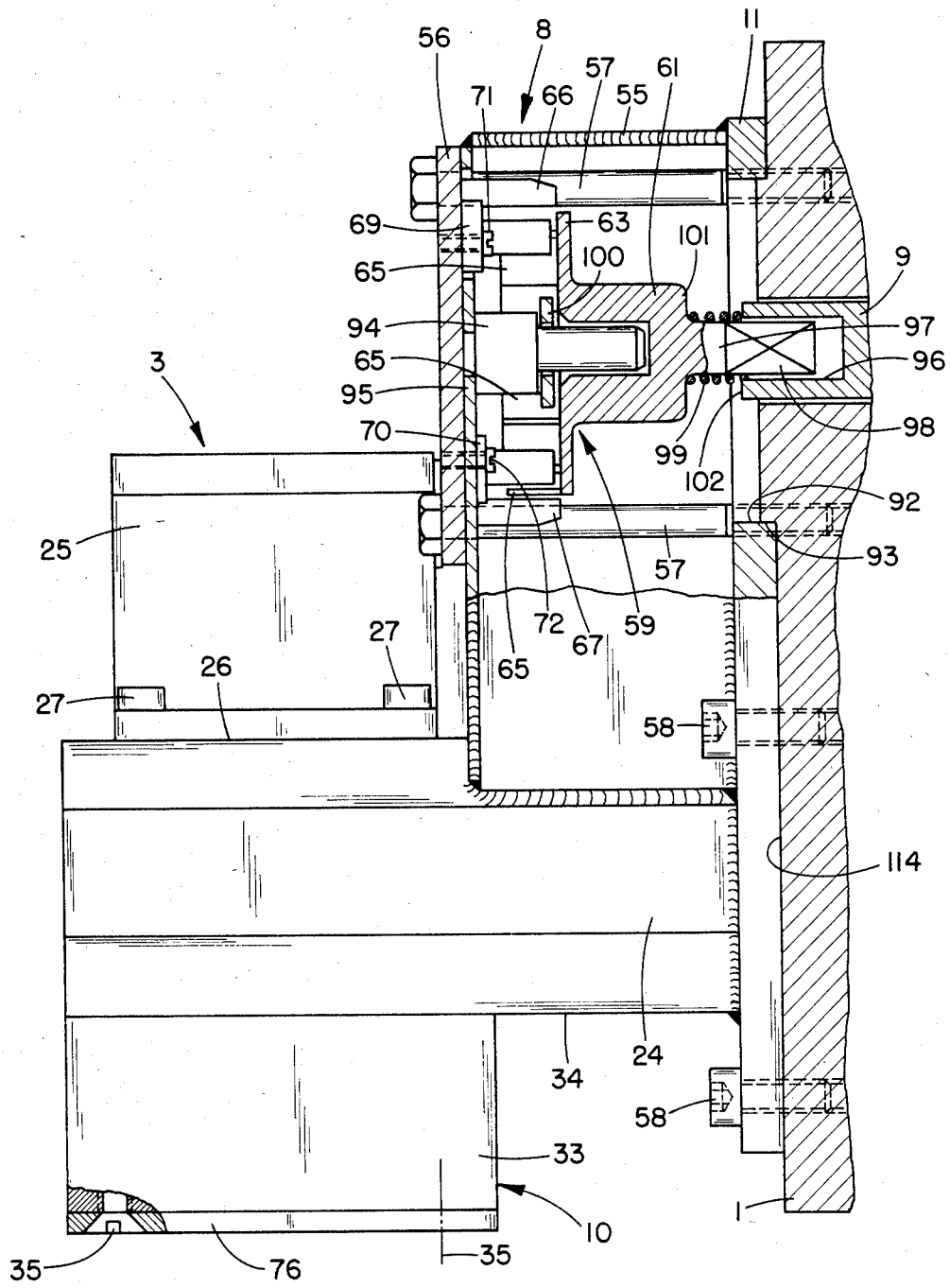
FIG. 8 is section through an alternative form of control device in the tachometer generator part thereof.

The signal producing means of the step generator 10 and of the tachometer generator 8 are formed by components which in principle are identical to each other. These signal producing means are pulse generating rotors, the rotor 46 of the step generator 10 having been alluded to earlier. The pulse generator rotor of the tachometer generator 8 is denoted by reference numeral 59. Each of these pulse producing rotors 46 and 59, respectively, consists of a round disk 62 on 60 or 63 on 61 secured by a hub 60 on 46 and 61 on 59 the respective shaft 41 or 9 serving as the drive shaft. On the circumferences of the disks there are axially projecting and equally spaced pulse producing means 64 on 62 and 65 on 63 which are arranged along a coaxial circular line. The individual pulse producing means have the form of tube segments. The pulse producing means 65 of the tachometer generator 8 have two magnetic detector forks 66 and 67, whereas the pulse producing means 64 of the stepper motor 10 only have one magnetic detector fork 68. The magnetic detector forks 66 and 67 of the tachometer generator 8 are, as indicated in FIGS. 4, 5 and 8, each arranged on a plate 69 and 70, respectively, which are each secured by two screws 71 and 72, respectively, on the inner side of the cover 56 of the tachometer generator housing 33. Each of these plates 69 and 70 is connected by a pulse pickup cable, not shown, with the microprocessor, such cable extending through a respective opening 73 or 74 in the housing cover 56. The magnetic detector fork 68 of the step generator 10 is also arranged on a plate 75, which is secured to the inner side of a cover 76 of the step generator housing 33 by means of screws 77. The housing cover 76 is located in place in the step generator housing 33 by a locating pin 78 and attached by a number of screws 35, as mentioned earlier, which serve to secure the step generator housing 33 on the housing 24. Furthermore, the plate 75 is connected with the microprocessor by means of a pulse pickup cable passing through an opening 79 in the housing cover 76.

The magnetic detector forks 66 and 67 or 68 extend respectively on the two sides of the circular path of the pulse generating means 64 and 65 of the tachometer generator 8 and of the step generator 10, respectively, of the respective disk 62 and 63 and each give rise to a magnetic field so that when one of the pulse generating means 64 or 65, respectively, passes between the fork prongs a Hall pulse will result which is representative of the angle of turning or of the rotation step.

The shaft, with which the pulse generating rotor 46 of the step generator 10 is connected, is the input shaft 41, which is extended into the housing 33 of the generator 10, of the step-down gear transmission 6. In this respect the hub 60 is arranged on the outer free end of the input shaft 41 via distance pieces 80 and 81 and a conical disk spring 82 so as to be spaced from the ball bearing 44 and is secured in place by means of a nut 84, screwed on a threaded pin 83, with a washer 85 in between. The step generator 10 is thus able to be preassembled and in a complete condition and then mounted on the housing 24. The advantage of this design is however that, if a step generator with different separate components such as more particularly pulse producing and signal producing means is necessary, such components may readily be put in place (and the other components removed) at any time without interfering with the other components of control device. The same also applies for any replacement after failure of the components of the step generator.

For the attachment of the pulse producing rotor 59 of the tachometer generator 8 two methods are basically possible, one method of attachment being shown in FIG. 5 and the other method of attachment being shown in FIG. 8.

In the method of attachment in accordance with FIG. 5 the pulse producing rotor 59 of the tachometer generator is directly attached to the free end, extending out of the fuel injection pump 1, of the shaft 9 of this pump. For this purpose an adapter cone 86 on the free end of the injection pump shaft 9 and a suitably fitting female conical bore 87 in the hub 61 of the rotor 59 are provided. In order to prevent twisting of the hub 61 in relation to the injection pump shaft 9 there is a key and groove connection 88. The pulse producing rotor 59 is in this case secured on the injection pump shaft 9 by means of a nut 90 screwed on the threaded end 89 of the shaft with a washer 91 in between. In this version of the design the remaining parts of the tachometer generator are mounted in or on the housing 55 of the tachometer generator in a pre-assembled condition. To make it possible for the pulse producing rotor 59, already secured to the end of the shaft 9 of the injection pump, to fit into the housing 55 of the tachometer generator on attaching the base plate 11 to the fuel injection pump, the base plate 11 has a through hole 92 with a diameter larger than the external diameter of the disk 63 of the rotor 59. This through hole at the same time serves to locate the base plate 11 on the fuel injection pump 1, there being a suitable projecting locating pin 93 on the outside of the latter. The through hole 92 and the pin 93 are also included in the design of all other working examples of the invention.

In the second method for attachment as shown in FIG. 8 an arrangement for the pulse producing rotor 59 of the tachometer generator 8 is selected which allows a complete pre-assembly of the same together with the other parts of the tachometer generator 8 in its housing 55. In this respect the pulse producing rotor 59 and its hub 61 are rotatably fitted on a journal 94 which is attached to cover plate 95 of the housing 55 of the tachometer generator, which is also engaged by the housing cover 56. For producing the driving connection with the injection pump shaft 9 there is a blind hole 96 with an interlocking (i.e. non-circular) cross section to its outer free end 98 and a drive pin (interlocking with such section) forming a continuation of the hub 61. There is furthermore a compression spring 99 on the drive pin 97. The rotor 59 so assembled is inserted in an upward direction through the through hole 92 in the base plate 11 into the interior of the housing 55 and placed on the journal 94. On the journal itself the rotor 59 is then supported by a bearer plate 100 arranged thereon. Fitting of the tachometer generator 8 is then completed. In order to hold the rotor 59 in the fitted position it is only necessary to provide and put in place an auxiliary member as for example a cover cap in the hole 92 preventing the rotor from falling out. Such cap is removed in the course of final assembly operations mounting the control device on the fuel injection pump. Such final assembly including the connection of the rotor 59 with the injection pump shaft 9 having been completed, the end of the compression spring 99 will have one end bearing on a shoulder 101 on the hub 61 while the other end will bear against the outer end surface 102 of the shaft 9 of the injection pump so as to ensure that the pulse producing rotor 59 remains pressed against the bearer plate 100 on the journal 94 during operation of the tachometer generator.

In addition to the hole 92 in the base plate 11 and the locating pin 93 on the fuel injection pump 1 there are further locating or positioning means which on attachment of the base plate 11 ensure a correctly aligned setting of the same in relation to the fuel injection pump 1 and the parts thereof. These further locating means are arranged at a position remote from the above-noted position and are similar in design. This may be seen from FIG. 4; in this respect it is a question of a further locating hole 103 present in the base plate 11, into which there fits a locating pin 104 on the fuel injection pump 1. These two locating means 92, 93 and 103, 104 mean that all the parts pre-assembled on the plate 11 thereon may be placed with the correct alignment in relation to the parts of the control device pre-assembled on the fuel injection pump. These components of the control device are on the one hand the tachometer generator 8, which is to be drivingly connected with the injection pump shaft 9 in accordance with the design of FIG. 5 or of FIG. 8, and furthermore the connection of the spring force storage means 4 with the control rod 2 via the force transmitting rod 7. In this case as well various versions are possible as will be described in what follows.

Figure 9:
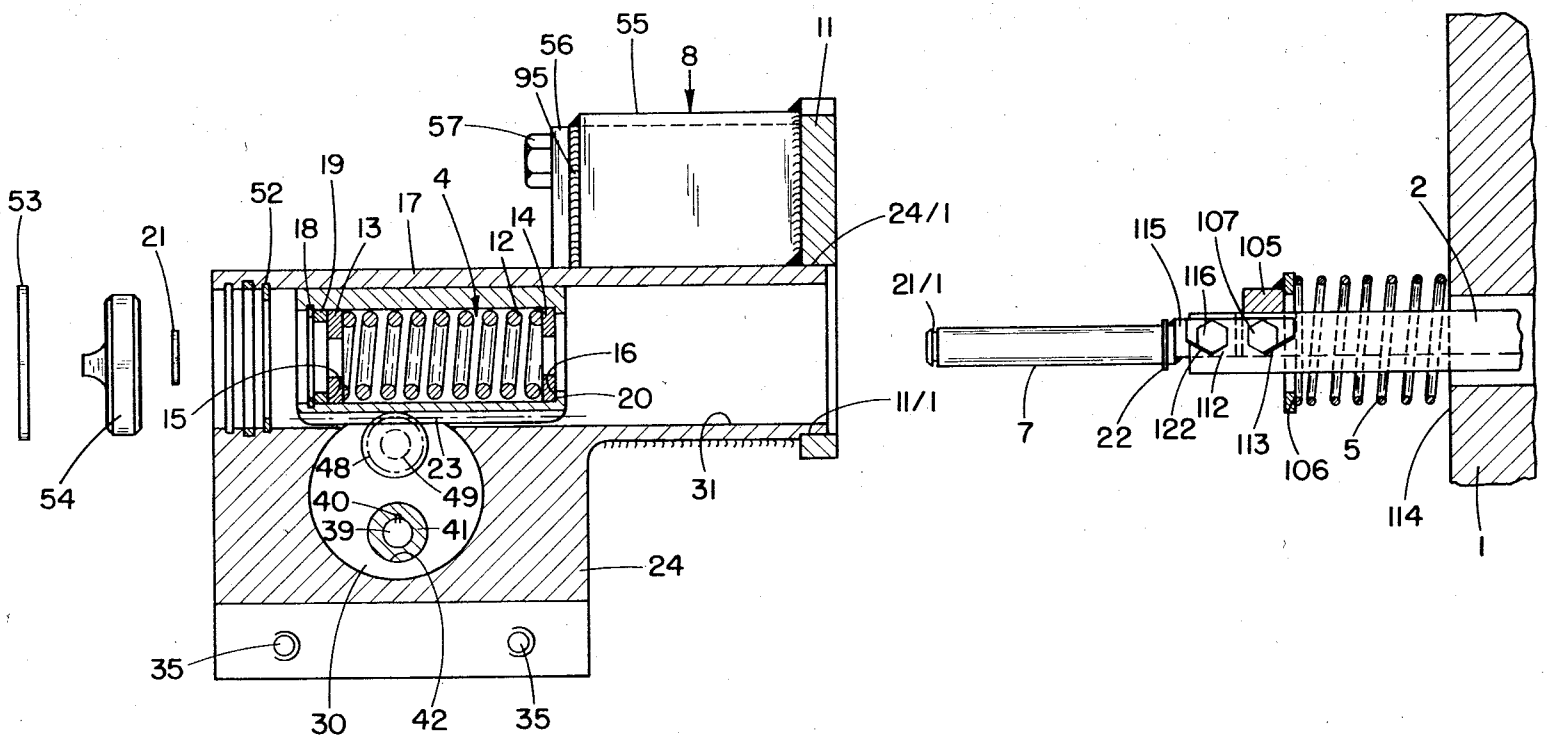
FIG. 9 is an exploded view of some of the parts of the control device as shown in the FIGS. 1 through 8 before final fitting to the fuel injection pump.

FIGS. 2, 6, 7 and 9 show a first design of the connection of the spring force storage means 4 via the force transmitting rod 7 with the control rod 2. In this respect it is a question of version of the connection involving a control rod 2 with an L-like cross section, which extends to some degree past the general outline of the fuel injection pump 1 and which at its outer end accommodates the force transmitting rod 7 and furthermore the return spring 5. The order of assembly of the parts is shown in FIG. 9 in which firstly the return spring 5 is slipped over the outer free end of the control rod 2 in the zero delivery setting, whereupon the spring is tensioned and held in the tensioned condition by an abutment. This abutment consists, as may be seen from the details of FIG. 7, of a connection block 105 and a belleville washer 106 rigidly secured to the block and which has an external diameter slightly smaller than the hole 31 for the spring force storage means 4. The connection block 105 possesses two abutment edges placed a right angle to each other so that the block 105 engages the two limbs of the cross section of the L-like control rod 2. The connection block 105 is attached to the control rod 2 by means of a screw 107 whose head 108 is locked on the outer side of the perpendicular limb of the cross section of the control rod 2, while the shank 109 of the screw extends through a transverse hole 110 in the control rod 2 to be held in an aligned tapped hole 111 in the connection block 105 and presses the latter in the fitted position on the inner side of the perpendicular limb of the cross section of the control rod 2. The screw 107 is locked by the angled lug 113 of a lock washer 112, such lug 113 resting against the outer face of the screw head 108. After such attachment of the washer 106 by means of the connection block 105 the return spring 5 is located in its tensioned condition between a bearer face 114 on the fuel injection pump 1 and the washer 106. Directly in front of the connection block the force transmitting rod 7 is secured to the control rod 2 by means of connection piece 115 arranged on one side thereof, such connection piece having a cross section adapted to the L-form of the control rod 2. As will be seen from the details in FIG. 5, the force transmitting rod 7 is secured by means of a screw 116, whose bearing shank 117 extends through a through bearing hole 118 in the perpendicular shank of the control rod 2 and bears at the end face thereof on the outer side of the connection piece 115 whereas its threaded shank 119 is screwed into a threaded through hole 120 and its head 121 holds the control rod 2 in the assembled condition while allowing a certain degree of axial play. The screw 116 is also secured by a lug 122 of the washer 112 resting against a surface on the screw head 121 to prevent it working loose.

In this working example of the invention the return spring 5, its abutments 105 and 106 and the force transmitting rod 2 form a sub-assembly to be fitted to the outer free end of the control rod 2. The remaining parts of the control device are furthermore to be fitted in or on the housing 24 and the base plate 11 in a pre-assembled condition, in which respect in the case of the tachometer generator 8 the fitting operation may be as in the case of FIG. 5 or of FIG. 8. On fitting the base plate 11 to the fuel injection pump 1, the force transmitting rod 7 fitted to the control rod 2 is then inserted into the hole 31 so as to extend right the way along the length of the spring force storage means 4 within it. After attachment of the base plate 11 to the fuel injection pump 1 the last step is to secure the spring force storage means 4 to the force transmitting rod 7, the pressure plate 14 of the latter then being moved into engagement with the abutment 22, whereafter the external abutment in the form of the locking ring 21 is placed in its groove 21/1. Lastly the hole 31 is closed by the plug 54 and it is locked in place by the insertion of the locking ring 53.

Figure 10:
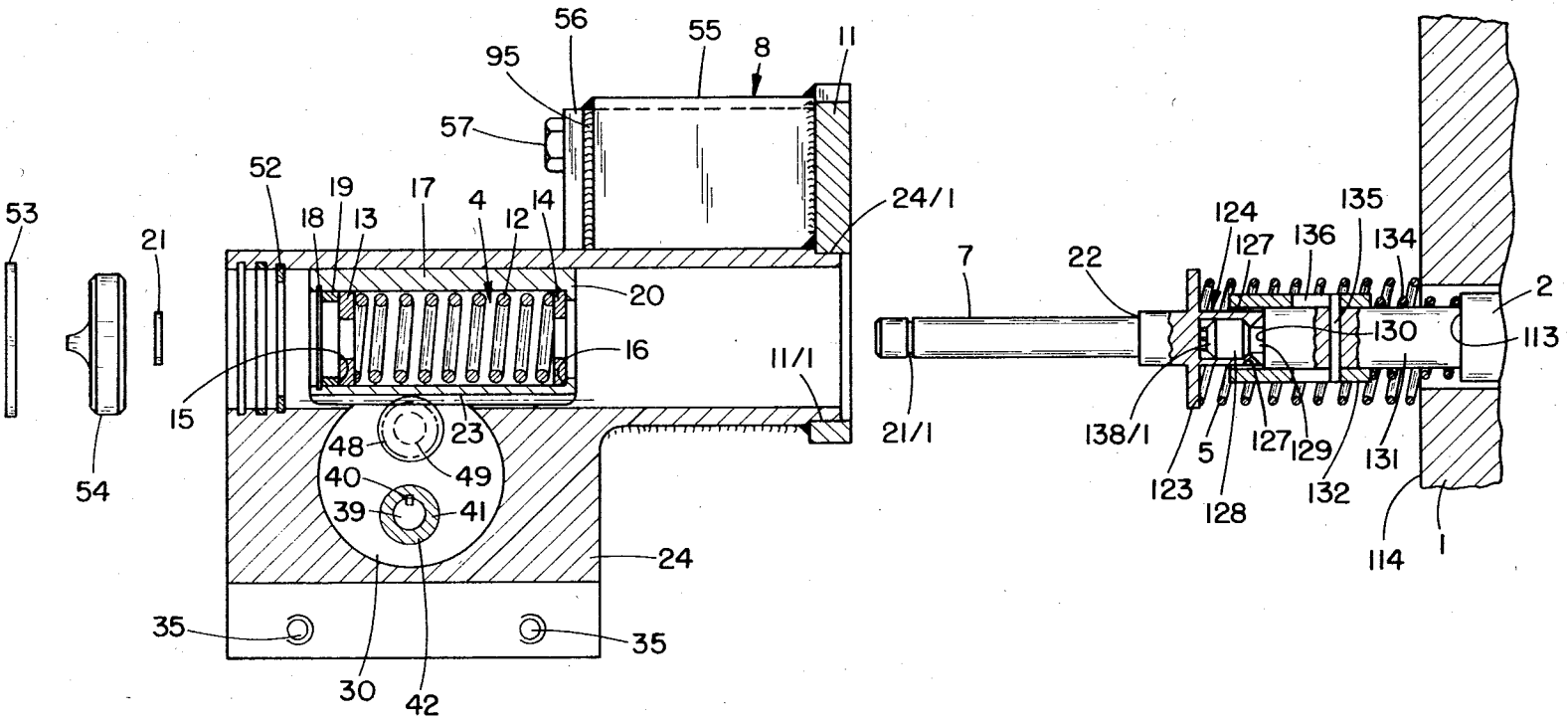
FIG. 10 is an exploded view of parts of an alternative control device prior to its final fitting in place using a first assembly method.
Figure 11:
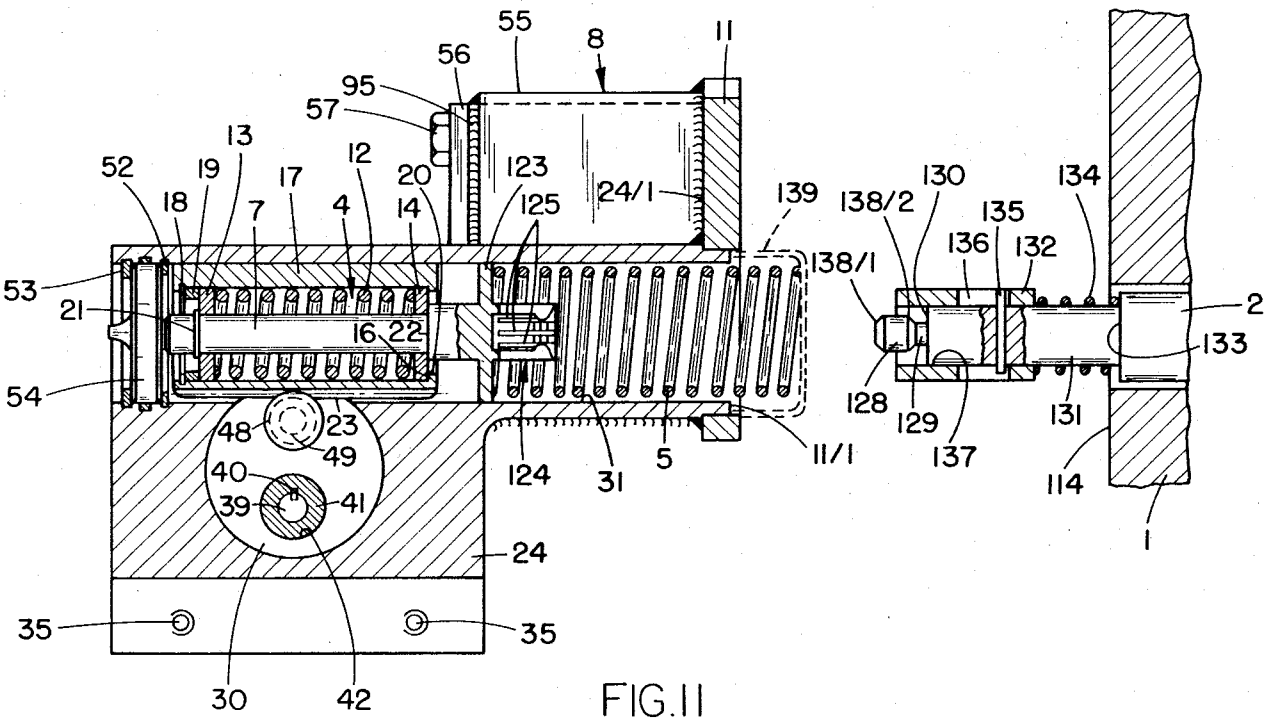
FIG. 11 is an exploded view of some of the parts of the alternative control device as shown in FIG. 10 prior to its final fitting in place, in accordance with a second assembly method.
Figure 12:
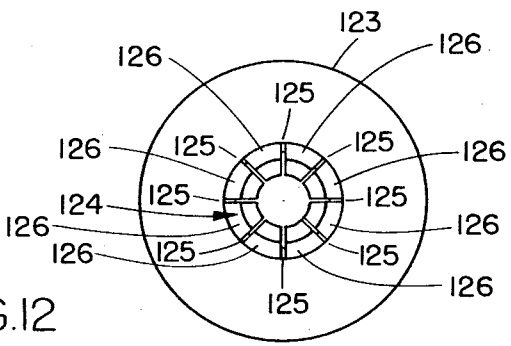
FIG. 12 is a front view of the force transmitting rod employed in FIGS. 10 and 11.

An alternative to the above-described design is to be seen in FIGS. 10, 11 and 12, there then being a novel form of coupling between the control rod 2 and the force transmitting rod 7 which enables alternative methods of pre-assembly to be utilized. Generally the arrangement is such that of the two abutments 21 and 22 on the force transmitting rod 7 for engaging the spring force storage means 4 on both sides at least the abutment further removed from the fuel injection pump 1 is able to be detached and is formed by a locking ring 21 fitting into a groove 21/1. There is a bearer plate 123 forming an abutment for the return spring 5 on the force transmitting rod 7 so as to be spaced from the abutment 22 nearer to the fuel injection pump, and in front of the latter towards the end there is one-half of a plug-in coupling means. The other part of the plug-in coupling is formed by a sleeve 124 which in the present form of the invention as shown is arranged on the outer end of the force transmitting rod 7 next to the bearer plate 123. This sleeve 12 has an outer coupling wall divided up by longitudinal slots (see FIG. 12) into separate fingers 126 and which is elastic. At the end face of the coupling sleeve its individual fingers 126 are each provided with inwardly thickened gripping jaws 127. The other part of the coupling, which in the instant case is arranged on the free end of the suitably designed control rod 2 of a adapter piece thereon, is formed by a male head 128. This male head 128 has a sleeve-expanding cone 138/1 and 138/2 at its front and rear ends, each being formed by a chamfer, and is arranged on a holding neck 129 which is coaxial to a flat end face 130 of a cylindrical section 131 of the control rod 2. For the male head 128 there is a securing sleeve 132 which is able to slide on the cylindrical section 131 of the control rod 2 axially against the force of a compression spring 134 engaging it to the rear and bearing against an abutment surface 133 and it is prevented from falling out by a locking pin 135. The latter extends through the cylindrical section 131 transversely and projects into at least one longitudinal groove 136 in the securing sleeve 132. In the position furthest to the front, which is the locking or securing position, the securing sleeve 132 covers over the holding neck 129 and at least half of the male head 128 in an axial direction. The external diameter of the male head 128 is slightly smaller than the internal diameter of the coupling sleeve 124.

In the part of the cross section between the end surface 130, the holding neck 129, the male head 128 and the through hole 137 of the securing sleeve 132 the wall thickness of the sleeve's peripheral wall divided up into the individual fingers 126 and of the thickened gripping jaws 126 is such that in the coupled condition there is no axial play or only a small amount of such play.

The above-described plug-in coupling makes possible two methods of pre-assembly of which one is shown in FIG. 10 and the other is shown in FIG. 11. In the method of assembly shown in FIG. 10 the first step is to slip the return spring 5 onto the cylindrical section 131 of the control rod 2 having the compression spring 134 and the securing sleeve 132 already fitted to it. After this the front coupling sleeve 124 of the force transmitting rod 7 is slipped over the male head 128. On axially directed movement taking place onto the male head 120 the first effect is for the coupling sleeve 124 to be expanded by the sleeve expanding cone 138/1 so that on further axial sliding of the expanded coupling sleeve 124 the securing sleeve 132 is displaced axially against the force of the compression spring 134 and simultaneously the return spring 5 is tensioned, the control rod 2 being held in the zero delivery setting. This axial displacement takes place till the end face of the coupling sleeve 124 strikes against the end face 130 of the cylindrical section and the gripping jaws 127 snap into place on the holding neck 129. The coupling sleeve 124 then resumes its outer cylindrical form so that the securing sleeve 132 is pushed back by the force of the expanding compression spring 134 into its securing position in which expansion of the coupling sleeve 124 is effectively prevented (because it is externally gripped) and at the same time the return spring 5 is clamped between the pressure plate 123 and the bearer surface 114 on the fuel injection pump 1. The compression spring 5 and the customized force transmitting rod 7 thus form a group of parts of the control device which may be made into a sub-assembly. The remaining parts of the control device are pre-assembled in or on the housing 24 and on the base plate 11 and form a sub-assembly with the latter which may then be fitted as a unit. In the case of the tachometer generator this pre-assembly operation may be carried out as in FIG. 5 or as in FIG. 8. On fitting the base plate 11 with such parts assembled on it the first step is for the force transmitting rod 7 as assembled on the control rod 2 to be fitted into the hole 31 in the housing 24 so that it is inserted along the full length of the previously fitted spring force storage means 4. As soon as the base plate 11 is attached to the fuel injection pump 4 the means 4 is caused to engage the abutment 22 of the force transmitting rod 7 (if this has not happened previously) and then the securing ring 21 is slipped into the appropriate groove 21/1 so that the spring force storage means 4 is drivingly connected with the force transmitting rod 7. Lastly, in this case as well, the hole 31 is shut off by the plug 54 and the latter is held in this plugging position by the insertion of the securing ring 53.

As an alternative to the above-described method of assembly, the provision of the said plug-in coupling, as indicated above, allows another method of assembly which will now be described with reference to FIG. 11. In this case the control device of the present invention may be bodily fitted as a sub-assembly, that is to say, all its parts are fitted on and in the housing 24 and the base plate 11, respectively. The tachometer generator 8 is to be pre-assembled as shown in FIG. 8 in a complete form and a suitable covering cap is fitted in the through hole 92 in the base plate to prevent the pulse producing rotor 59 from dropping out of the tachometer generator housing. The force transmitting rod 7 is, as indicated in FIG. 11, already connected with the spring force storage means 4. Furthermore the receiving hole 31 in the housing 24 is already closed at one end by plug the 54, same being retained in place by the securing ring 53. The plug 54 then defines the abutment for the zero delivery setting of the force transmitting rod 7 and thus for the control rod 2 as well. Furthermore, the return spring 5 will have already been placed in the hole 31 in the housing 24 in its relaxed state after the pressure plate 123. To ensure that the spring 5 is held in place the hole 131 is shut off at one end by a cap 139 which may be later removed. On fitting the control device in a completely assembled state, i.e. as a sub-assembly, the first step in to remove the said caps and then to move the base plate 11 up to the fuel injection pump 1. When this is done the cylindrical section 131, fitted with the compression spring 134 and the securing sleeve 132, of the control rod 2 in the zero delivery setting, extends into the interior of the hole 31 so that the male head 128 plugs into the coupling sleeve 124. On further axial displacement the coupling sleeve 124 is expanded initially by the sleeve expanding cone 138/1 and then the latter causes axial displacement of the securing sleeve 132 with a simultaneous tensioning of the return compression spring. As soon as the coupling sleeve 124 engages the end surface 130 of the cylindrical section 131 of the control rod 2, it is possible for the gripping jaws 127 to snap home into the holding neck. The securing sleeve 132 moves back into its securing position (the compression spring then relaxing) in which accidental release of the coupling is not possible. When the coupling connection has been fully made the base plate as well 11 is completely in engagement with the fuel injection pump 1 and may be finally fixed in place.

Owing to the design in accordance with the invention one may generally say that a very compact control device has been created whose components are able to be mounted as sub-assemblies (i.e. in a pre-assembled condition) or in two or three groups of parts. However, even in a case in which pre-assembly is such that there are two or three groups of parts one may be sure of a particularly simple handling and rapid assembly. The latter means that the final fitting of the control device to the fuel injection pump may take place with only a few manipulations and with an automatic location of the parts that are to be joined together. Furthermore, all the individual parts of the control device may be replaced separately quite simply and with a few manipulations after failure at any time.

I claim:

1. A control device for the setting of the timing and/or the delivery rate of a fuel injection pump (1) for IC engines in which the setting signals of a microprocessor are able to be transmitted by an electrical stepper motor (3) via motion transmitting members (6 and 7) with an intermediately placed spring force storage means (4) to a control rod (2) and a return compression spring (5) is provided for the return of the control rod (2) into its zero delivery setting, the spring force storage means (4) having two spring plates (13 and 14) able to be moved in opposite directions and having a tensioned compression spring (12) between them, the maximum distance apart of the plates (13 and 14) being limited by abutments (15 and 16) in a surrounding housing (17), the stepper motor (3) on the one hand and the control rod (2) on the other hand being connected with the spring force storage means (4) through an intermediate motion transmitting member (6 and 7, respectively) and the motion transmitting member on the control rod side is a force transmitting rod (7) which extends through the two spring plates (13 and 14) and has abutments (21 and 22), which cooperate with the sides, remote from the compression spring of the spring force storage means, of the spring plates characterized in that the housing (55) of a mechanical tachometer generator (8) feeding signals to the microprocessor and, separately from this, a housing (24) containing the motion transmitting member (6), the spring force storage means (4), the force transmitting rod (7) and the return compression spring (5) are fixedly mounted on a base plate (11), in that on opposite sides of this housing (24) the stepper motor (3) and a step generator (10) detecting the steps thereof, each having their own housing (25 and 33, respectively), are flange-mounted, in that the stepper motor (3), the motion transmitting member (6) on the stepper motor side, the spring force storage means (4), the force transmitting rod (7) and the return spring (5) form a sub-assembly mounted on the base plate (11), and in that the base plate (11) is adapted to be flange-mounted with the aid of locating means (92, 93; 103 and 104) on the fuel injection pump (1) with the production of positionally correct operative connections of the power transmitting rod (7) and the control rod (2) on the one hand and of the injection pump shaft (9) and the tachometer generator (8) on the other hand, the rotating part (59) of the tachometer generator (8) having been previously mounted on the injection pump shaft (9) or mounted in the housing (55) of the tachometer generator (8).

2. A control device for the setting of the timing and/or the delivery rate of a fuel injection pump (1) for IC engines in which the setting signals for a microprocessor are able to be transmitted by an electrical stepper motor (3) via motion transmitting members (6 and 7) with an intermediately placed spring force storage means (4) to a control rod (2) and a return compression spring (5) is provided for the return of the control rod (2) into its zero delivery setting, the spring force storage means (4) having two spring plates (13 and 14) able to be moved in opposite directions and having a tensioned compression spring (12) between them, the maximum distance apart of the plates (13 and 14) being limited by abutments (15 and 16) in a surrounding housing (17), the stepper motor (3) on the one hand and the control rod (2) on the other hand being connected with the spring force storage means (4) through an intermediate motion transmitting member (6 and 7, respectively) and the motion transmitting member on the control rod side is a force transmitting rod (7) which extends through the two spring plates (13 and 14) and has abutments (21 and 22), which cooperate with the sides, remote from the compression spring of the spring force storage means, of the spring plates characterized in that the housing (55) of a mechanical tachometer generator (8) feeding signals to the microprocessor and, separately from this, a housing (24) containing the motion transmitting member (6), the spring force storage means (4), the force transmitting rod (7) and the return compression spring (5) are fixedly mounted on a base plate (11), in that on opposite sides of this housing (24) the stepper motor (3) and a step generator (10) detecting the steps thereof, each having their own housing (25 and 33, respectively), are flange-mounted, in that the stepper motor (3), the motion transmitting member (6) on the stepper motor side and the spring force storage means (4) form a sub-assembly mounted on the base plate (11), whereas the force transmitting means rod (7) and the tensioned return spring (5) form a sub-assembly mounted on the projecting control rod end on the injection pump (1) and in that the base plate (11) is adapted to be flange-mounted with the aid of locating means (92, 93; 103 and 104) on the fuel injection pump (1) with the production of positionally correct operative connections of the power transmitting rod (7) and the control rod (2) on the one hand and of the injection pump shaft (9) and the tachometer generator (8) on the other hand, the rotating part (59) of the tachometer generator (8) having been previously mounted on the injection pump shaft (9) or mounted in the housing (55) of the tachometer generator (8).

3. The control device as claimed in claims 1 or 2 characterized in that the housing (25) of the stepper motor (3) is mounted on the outer surface of the one side wall (26) and the housing (33) of the step generator (10) is mounted on the outer side of the opposite side wall (34) of the said common housing (24), each with indirect locating means and each secured by screws (27 and 35, respectively) in a detachable manner.

4. The control device as claimed in claims 1 or 2 characterized in that in the common housing (24) a receiving hole (31) is provided in which the spring force storage means (4) and its housing (17) are accommodated so as to be able to slide in the direction of the axis of the control rod (2), said hole (31) furthermore containing a return compression spring (5) and an abutment (105, 106; 123) for the latter, the force transmitting rod (7) and the end, projecting from the fuel injection pump (1), of the control rod (2).

5. The control device as claimed in claims 1 or 2 characterized in that in the common housing (24) there is a receiving space (30) for the accommodation of a step-down gear transmission (6), which as a motion transmitting member on the stepper motor side on the one hand is connected with the stepper motor and on the other hand with a linear geartooth configuration (23) arranged on the housing (17) of the spring force storage means (4).

6. The control device as claimed in claim 5 characterized in that the space (30) for the step-down gear transmission (6) in the housing (24) is open towards the housing (33) of the step generator, but however in the fitted state of the latter is covered by the floor (32) thereof.

7. The control device as claimed in claim 6 characterized in that the shaft (39) of the stepper motor (3) projects into the space (30) for the step-down gear transmission (6) and is coupled via a slot and key connection (40) with a coaxially arranged, partially overlapping input shaft (41) of the step-down gear transmission (6), said input shaft (41) having its one end passing through a hole (42) in the side wall (26) of the housing (24), passing through the length of the space (30), extending into the housing (33) of the step generator (10) and being supported in the floor (32) of the housing (33) of the pulse generator in a bearing (32) therein, and furthermore on the same side of the bearing (44) it carries a first gearwheel (45) of the step-down gear transmission (6) and on the other side of the bearing (44) it carries a pulse producing rotor (46), functioning within the housing (33) of the step generator, as a part of the step generator (10).

8. The control device as claimed in claim 7 characterized in that the step-down gear transmission (6) consists of three gearwheels in all, namely a first gearwheel (45) mounted on the input shaft (41), a second gearwheel (47) meshing with the latter gearwheel and having a larger number of teeth than it, and a third gearwheel (48) having a smaller number of teeth than the first and second gearwheels and meshing with the linear gear-tooth configuration (23) on the housing (17) of the spring force storage means, said third gearwheel like the second gearwheel being secured to an output shaft (49) arranged so that its axis is parallel to the input shaft (41), said output shaft being bearinged at one end in the side wall (26) associated with the stepper motor (3) of the common housing (24) and at the other end in the floor (32) of the housing (33) of the step generator and in that the spring force storage means housing (17) is arranged in a plane, which is normal to the two shafts (41 and 49) of the step-down gear transmission (6), in the hole (31) in the common housing (24) so that it may be displaced axially.

9. The control device as claimed in claim 8 wherein the hole (31) in which the housing (17) of the spring force storage means is arranged intersects the space (30) receiving the step-down gear transmission (6) in order to form a driving connection with the third gearwheel thereof, and extends fully through the common housing (24) in the length direction thereof and at one end is fitted with a securing ring (52), whose inner side defines the zero delivery setting, and is fitted with a plug (54) and at the other end, passing through the base plate (11) receives the end, projecting from the fuel injection pump (1), of the control rod (2) and the means for connecting the latter with the force transmitting rod (7) and the abutment (105, 106; 123) for the return spring (5).

10. The control device as claimed in claim 1 or claim 2 characterized in that that on the base plate (11) and on the fuel injection pump (1) there are a number of spaced means (92, 93; 103, 104) interlocking with each other, which on attachment of the base plate (11) ensure a correctly located and twist-free association in position of the latter and of the parts mounted on it in relation to the fuel injection pump (1) and the parts thereof and in that the base plate (11) is able to be secured by screws (57 and 58) on the fuel injection pump (1).

11. The control device as claimed in claims 1 or 2 characterized in that the end, adjacent to the base plate (11), of the injection pump shaft (9) is adapted for the driving and interlocking connection of the pulse producing rotor (59) of the tachometer generator (8).

12. The control device as claimed in claims 1 or 2 characterized in that the signal producing means of the step generator (10) and of the tachometer generator (8) are made up of principally identical parts.

13. The control device as claimed in claim 12 characterized in that the signal producing means are formed by (a) a round disk (62 or 63, respectively) connected via a hub (60 or 61, respectively) with the shaft (9 or 41, respectively) serving for the drive, on the periphery of which disk there are axially projecting and identically formed pulse producing means (64 or 65, respectively) which extend with regular spacing along a coaxial line, and (b) magnetic forks (66, 67 and 68, respectively), which are arranged stationarily by means of plates (69, 70 and 75, respectively) on the respective housing cover (56 and 76, respectively) on the inner side so as to project axially and form a magnetic field and on the passage therebetween of one of the pulse producing means (64 or 65, respectively) produce a Hall pulse, which is representative for the angle of turning of the injection pump shaft (9) or a rotary step of the stepper motor (3).

Figure 6:
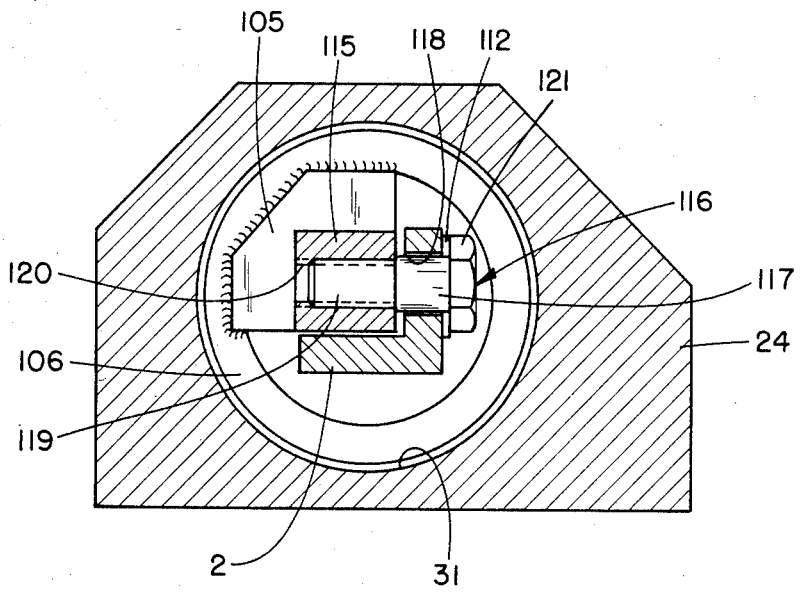
FIG. 6 is a further section through the control device, taken on the line section line VI—VI of FIG. 2.
Figure 7:
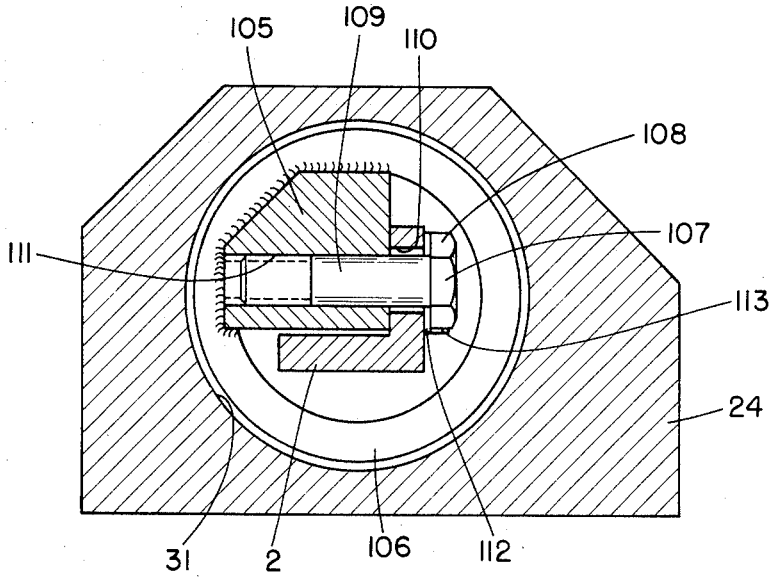
FIG. 7 is a section through the control device taken on the line VII—VII of FIG. 2.

14. The control device as claimed in claim 2 characterized in that at the end of the force transmitting rod (7) there is a connection member (115), which is adapted in its shape to the form of the control rod end and is secured to the latter by means of a screw (116), in that following the connection member (115) on the control rod (2) there is a connection block (105) fixed thereon by means of a screw (107), said block carrying a pressure plate (106), between which and a section of the outer wall (114) of the fuel injection pump (1) there extends the tensioned return spring (5), in that on the force transmitting rod (7) at least the abutment adjacent to the outer free end and serving for the spring force storage means (4) is formed in a removable manner and more especially is formed by a securing ring (21) and which on attachment of the base plate (11) on the fuel injection pump (1) after completely passing through the spring force storage means (4) is able to be inserted into the force transmitting rod (7) in a groove (21/1) on the latter for producing the driving connection (FIGS. 6, 7 and 9).

15. The control device as claimed in claim 1 or claim 2 characterized in that of the two abutments (21 and 22) serving for engaging the spring force storage means (4) on both sides at least the abutment which is further removed from the fuel injection pump (1) is formed in a removable manner, more especially in the form of a securing ring (21) fitting into an annular groove (21/1), in that on the force transmitting rod (7) at a greater distance from the other abutment (22) there is a pressure plate (123) forming an abutment for the return spring (5) and in front thereof at the end there is the one part (124) of a plug-in coupling, whose other part (128 and 129) is arranged on the free end of the control rod (2, FIGS. 10, 11 and 12).

16. The control device as claimed in claim 15 characterized in that the one part (124) of the plug-in coupling is formed by a coupling sleeve arranged on the power transmitting rod (7) and cylindrical peripheral wall of the sleeve is made elastic by longitudinal dividing it up into a number of separate fingers (126) and is provided with inwardly thickened gripping jaws (127), in that the other part of the plug-in coupling is formed by a male head (128) and a holding neck (129), which adjoins the end surface (130) of a cylindrical section (131) on the control rod (2) in a axially projecting manner and coaxially in front of same carries the male head (128) with a larger diameter, said male head carrying on the front and rear ends a respective sleeve expanding cone (138/1 and 138/2, respectively), and in that the male head (128) is provided with a securing sleeve (132) able to slide on the cylindrical section (131) against the force of a compression spring (134) between two terminal positions, the internal diameter of the sleeve (132) being slightly greater than the external diameter of the sleeve (124) and the sleeve (132) being able to slide axially on engaging the sleeve (134) through the end surface of the peripheral wall which is then expanded and after snapping into place of the gripping jaws (127) around the holding neck (129) is able to be returned into the initial position by the compression spring (134), in which initial position an expansion of the sleeve (124) and uncoupling of the connection is effectively prevented.

* * * * *